US006122438A

United States Patent [19]

Scherzer et al.

[11] Patent Number: 6,122,438

[45] Date of Patent: Sep. 19, 2000

[54] SHORT-WAVE INFRARED SURFACE RADIATOR ASSEMBLY WITH ANGLED CONNECTION TUBES

[75] Inventors: Joachim Scherzer, Bruchkobel; Werner Kreuter, Hanau; Frank Brehm, Karlstein, all of Germany

[73] Assignee: Heraeus Noblelight GmbH, Hanau, Germany

[21] Appl. No.: 09/315,041

[22] Filed: May 20, 1999

[30] Foreign Application Priority Data

May 20, 1998 [DE] Germany ..... 198 22 829

[51] Int. Cl.[7] ..... H05B 3/44

[52] U.S. Cl. ..... 392/411; 392/407; 219/541; 362/225; 313/110; 250/495.1

[58] Field of Search ..... 392/407, 411–413; 219/541, 553, 462.1; 362/225, 227, 249; 313/1, 110; 250/495.1

[56] References Cited

U.S. PATENT DOCUMENTS

| | | | |
|---|---|---|---|
| 2,629,814 | 2/1953 | Brown | 362/225 |
| 3,005,081 | 10/1961 | Kordes et al. | 392/411 |
| 3,240,915 | 3/1966 | Carter et al. | 392/416 |
| 3,262,004 | 7/1966 | Keller | 362/225 |
| 3,309,499 | 3/1967 | Carr | 392/411 |
| 3,627,989 | 12/1971 | Heidler et al. | 219/553 |
| 5,091,632 | 2/1992 | Hennecke et al. | 219/553 |

FOREIGN PATENT DOCUMENTS

| | | | |
|---|---|---|---|
| 4328119 | 3/1995 | Germany . | |
| 29701200 U | 3/1997 | Germany . | |
| 2300553 | 11/1996 | United Kingdom | 219/541 |

*Primary Examiner*—John A. Jeffery
*Attorney, Agent, or Firm*—Oblon, Spivak, McClelland, Maier & Neustadt, P.C.

[57] ABSTRACT

A short-wave infrared surface radiator, with at least one infrared radiator, is equipped with a cladding tube. The cladding tube encloses, in a vacuum-tight manner, a heating element, which has an electric connection that is guided out of the cladding tube on a connection-side end via a pinch on a face of the cladding tube. A molybdenum foil is sealed into the cladding tube. Several infrared radiators that are connected to each other are arranged in an adjacent and parallel design while forming a joint radiating plane, with the connection-side end of the cladding tubes each being angled with regard to the radiating plane. The cladding tubes are fused together in an area of their front side that is opposite an angled section.

9 Claims, 2 Drawing Sheets

SHORT-WAVE INFRARED SURFACE RADIATOR ASSEMBLY WITH ANGLED CONNECTION TUBES

BACKGROUND OF THE INVENTION

1. Field of the Invention

The invention concerns a short-wave infrared surface radiator with at least one infrared radiator that comprises a cladding tube which encloses—in a vacuum-tight way—the heating element, which is equipped with an electric connection that is guided out of the cladding tube on the connection side via a pinch on the face of the cladding tube into which a molybdenum foil is sealed.

2. Discussion of Background

Such infrared surface radiators are utilized, among other things, for the polymerization of synthetics or in the hardening process of lacquers or drying process of paints. Known surface radiators have a cladding tube that is bent meander-shaped or spiral-shaped in a radiating plane. The cladding tube surrounds a heating element, which is connected with electric current supply hook-ups. The connections are generally guided out of the cladding tube on the face of the cladding tube via pinches into which a molybdenum foil is sealed.

Also known are so-called twin tubes where a cladding tube is divided into two partial sections that run parallel to each other by a center rail that runs in the direction of the longitudinal axis, with a heating element being arranged generally in both partial sections. The two heating elements are connected with a contact pin in the area of one of the twin cladding tube's fronts; this contact pin protrudes through the center rail. The electric connections for the heating elements are generally guided out via the pinches on the same front of the twin tube.

Production of such known infrared surface radiators is relatively demanding. The areas around the electric connections are not heated, which leads to reduced power density if several surface radiators are arranged next to each other and can be disadvantageous in the radiators' applications in rooms that are difficult to access or of limited space, with the bulky electric connection in particular representing a hindrance.

The invention is therefore based on the task of making a short-wave infrared surface radiator available with high power density, which can be easily produced and is easily handled.

SUMMARY OF THE INVENTION

Based on the short-wave infrared surface radiator described above, the task is resolved with the invention in that several infrared radiators that are connected to each other are arranged in an adjacent design and parallel to each other while forming a joint radiating plane, with the end of the cladding tube that is located on the side of the connection being angled with regard to the radiating plane.

According to the invention, several cladding tubes are arranged parallel and next to each other. In an ideal case, the cladding tubes would be located directly next to each other, without any space in between. Usually the heating elements are located in a joint plane that defines the radiating plane. The main radiating direction of the surface radiator runs vertical to the radiating plane.

In accordance with the invention, the end of the cladding tube that is located on the connection side is angled with regard to the radiating plane. At least one of the electric connections for the heating element is guided out of the connection-side end of the cladding tube.

Generally, the cladding tubes are designed straight at least in the radiating plane. However, they can also be bent in the radiating plane. The only important aspect here is that several cladding tubes are arranged parallel to each other.

The result of the invention's design and shape of the cladding tubes is an infrared surface radiator shaped like an angle, with one leg of the angle running parallel to the radiating plane, and with the electric connections for the heating elements being guided through the other leg. Due to the angled sections of the connection-side ends of the cladding tubes, short unheated partial sections (of the cladding tubes) can be realized in the radiating plane on the one hand because the heating elements can be guided closely to the angled sections. This leads to a small surface that is not exposed to radiation and high powers of density. On the other hand, the bulky and rigid connection wires for the electric connection are taken out of the radiating plane, which facilitates handling of the surface radiator, particularly in areas that are difficult to access.

It has proven to be particularly beneficial to angle the cladding tubes in the area of the pinch, particularly in the foil area of the pinch. This way the heating elements can be guided closely to the angled section, which leads to particularly short unheated partial sections (of the cladding tubes). The foil area of the pinch is the area into which the molybdenum foil is sealed. Angled sections of the sealed molybdenum foil are simpler with regard to manufacturing engineering aspects than angled sections—which would also be feasible—in the area of the relatively rigid connection wires.

Beneficial variations of the invented short-wave infrared surface radiator result from the dependent claims.

BRIEF DESCRIPTION OF THE DRAWINGS

In the following, the invention is explained more in detail with the help of an example of one version and a patent drawing. The drawing shows a version of the invented infrared surface radiator in a diagrammatic view. In detail

DETAILED DESCRIPTION OF THE PREFERRED EMBODIMENTS

Figure 1:
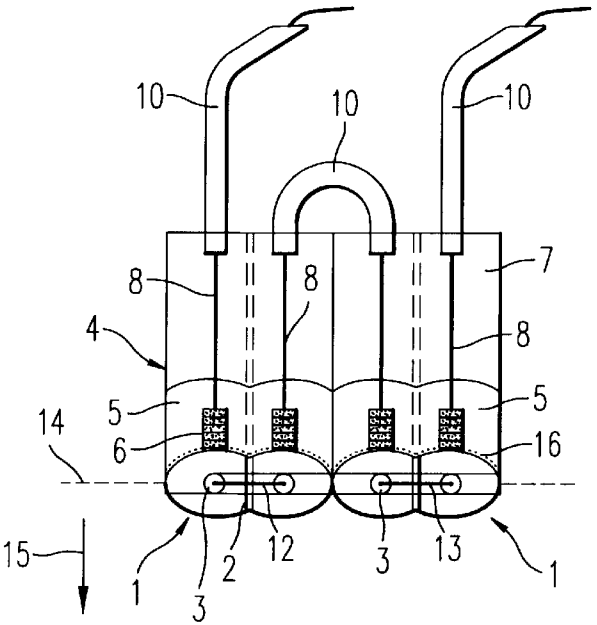
FIG. 1: a front view.
Figure 4:
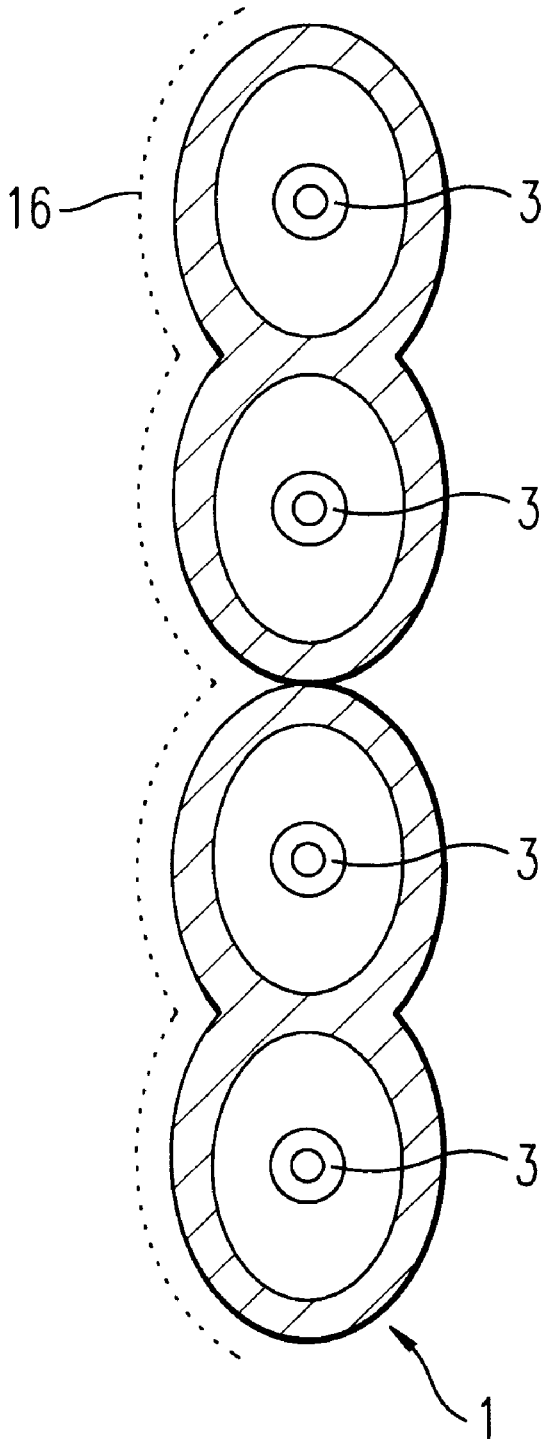
FIG. 4: a cross-sectional view taken along a line Iv—Iv in FIG. 3 are shown.

The surface radiator depicted in FIG. 1 comprises two quartz glass twin tubes 1, which run parallel to each other, next to each other, without a gap in between. The twin tubes 1, respectively, are divided by a center rail 2 into two partial sections where a heating element 3, respectively, is held. The front view in FIG. 1 provides a particularly clear picture of the connection-side end 4 of the surface radiator. It is angled upward with regard to the radiating plane 14.

The electric connection for the heating elements 3 is always installed on the same face (see also FIGS. 2 and 3) of the twin-tube radiator 1 via a pinch 5, into which a molybdenum foil 6 is sealed. Therefore all electric connection wires are also guided via this one (connection-side) face of the surface radiator.

Pinches 5 on the connection side run into a hollow space, which is described as a tulip-shaped area 7. On both sides of the pinch 5 the molybdenum foil 6 is connected with electric connection wires 8, 9. The connection wire 8 is guided within this tulip-shaped area 7 and surrounded by a cord 10 above the tulip-shaped area.

The two heating elements 3 within a twin tube 1 are connected electrically with each other in the area of the end 11 of the surface radiator that faces away from the connection-side end 4 via a contact pin 12, which protrudes through the center rail 2. The end 11 of each twin-tube radiator I as well is enclosed in a vacuum-tight manner due to a pinch 13. For this, the neighboring pinches 11 are designed as a continuous rail 13 that connects the two twin tubes 1 with each other.

All (four) heating elements 3 are connected electrically in series in the example.

FIG. 1 hints at the radiating plane of the surface radiator with a dotted line 14; it stretches vertically to the paper plane. The arrow 15 shows the main radiating direction.

In the area of the radiating plane 14, the upper side of the quartz glass twin tube 1 is coated with a gold reflector 16—except in the area of the pinches—which is symbolized in FIGS. 1 through 4 with a dotted line.

Figure 2:
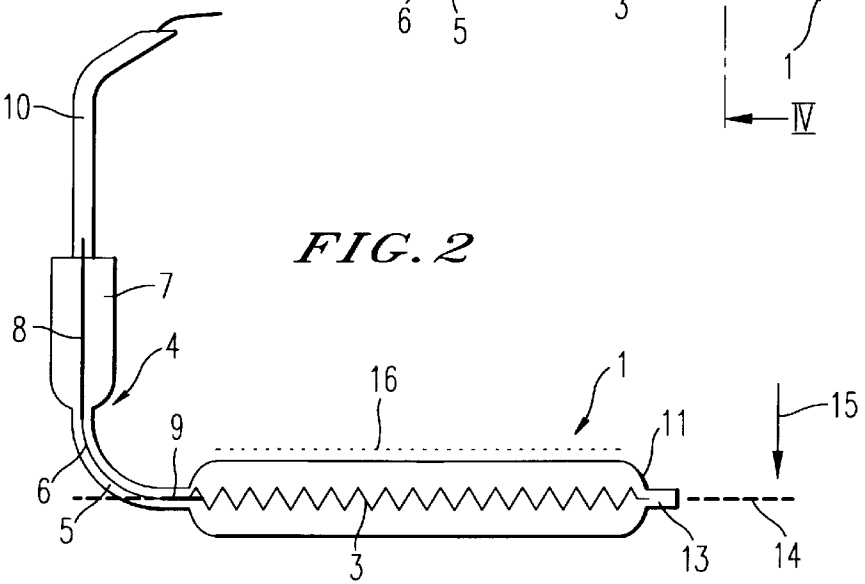
FIG. 2: a side view.

FIG. 2 shows that the connection-side end 4 of the respective twin tube 1 or the surface radiator is bent upward at an angle of 90° with regard to the radiating plane 14 and contrary to the main radiating direction 15. This bent area is designed in the area of the sealed foil, so that the sealed molybdenum foil 6 is bent upward by 90°. Each twin tube 1 may be angled between 45° and 135°. To be able to provide a clear presentation, the bent area in FIG. 2 is shown not to scale but rather enlarged. Due to the bent area, the heating elements 3 stretch over almost the entire radiating plane 14, which leads to narrow unheated surfaces in the area of the connection-side end 4 of the surface radiator. In unheated surfaces at least half of the pinch 5 is eliminated. Furthermore, due to the fact that the electric connections are bent upward, handling of the radiator is facilitated. Even small and angled rooms are areas where the invented surface radiator is easily accessible.

Figure 3:
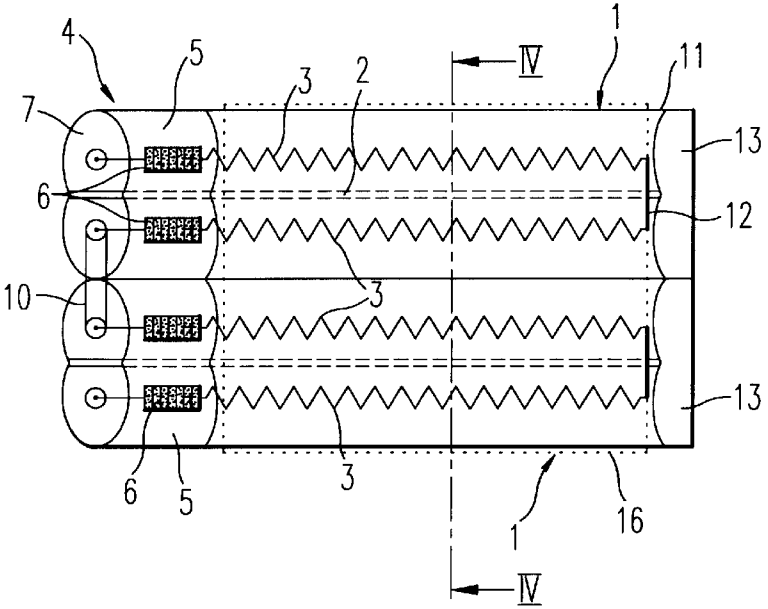
FIG. 3: a top view.

The top view in FIG. 3 shows the side dimensions of the invented surface radiator in the radiating plane, which runs parallel to the page plane in this picture. In the example, the surface that can be heated is 45 mm×45 mm. Such a surface radiator is designed for 500 W of electric power, which corresponds to a power density of about 250 kW/m$^2$ when taking the outer dimensions into consideration.

In the production of the invented infrared surface radiator familiar short-wave infrared radiators can be used. They are arranged parallel to each other, fused together in the area of the rail 13 and then angled at 90° in the area of the sealed foil.

What is claimed as new and desired to be secured by Letters Patent of the United States is:

1. Short-wave infrared surface radiator, with at least one infrared radiator, which is equipped with a cladding tube that encloses, in a vacuum-tight manner, a heating element, which has an electric connection that is guided out of the cladding tube on a connection-side end via a pinch on a face of the cladding tube into which a molybdenum foil is sealed, characterized in that several infrared radiators that are connected to each other are arranged in an adjacent and parallel design while forming a joint radiating plane, with the connection-side end of the cladding tubes each being angled with regard to the radiating plane, and in that the cladding tubes are fused together in an area of their front side that is opposite an angled section.

2. Infrared surface radiator, according to claim 1, characterized in that the cladding tubes are angled in the area of the pinch.

3. Infrared surface radiator, according to claim 1, characterized in that the cladding tubes are angled between 45° and 135°.

4. Infrared surface radiator, according to claim 3, characterized in that the cladding tubes are angled at 90° with regard to the radiating plane.

5. Infrared surface radiator, according to claim 1, characterized in that the cladding tubes are equipped with a reflective layer that is located opposite the radiating plane.

6. Infrared surface radiator, according to claim 1, characterized in that the cladding tubes are made from quartz glass twin tubes.

7. Infrared surface radiator, according to claim 1 characterized in that the pinch runs into a tulip-shaped area that encloses a connection wire for the electric connection.

8. Infrared surface radiator, according to claim 1, characterized in that the heating elements are connected in series.

9. Infrared surface radiator, according to claim 1, characterized in that the heating elements are arranged parallel to each other.

* * * * *

UNITED STATES PATENT AND TRADEMARK OFFICE

CERTIFICATE OF CORRECTION

PATENT NO. : 6,122,438
DATED : September 19, 2000
INVENTOR(S) : Joachim Scherzer, et al.

It is certified that error appears in the above-identified patent and that said Letters Patent is hereby corrected as shown below:

Title page,
Item [54], and column 1, the Title is incorrect. The Title should read as follows:

-- [54] SHORT-WAVE INFRARED RADIATOR ASSEMBLY WITH ANGLED CONNECTION TUBES --

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*